US007117993B2

(12) United States Patent
Koike

(10) Patent No.: US 7,117,993 B2
(45) Date of Patent: Oct. 10, 2006

(54) PACKING ARTICLE, A METHOD OF PACKING AND A PARTITION MEMBER

(75) Inventor: Motomu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 10/396,376

(22) Filed: Mar. 26, 2003

(65) Prior Publication Data

US 2003/0234207 A1 Dec. 25, 2003

(30) Foreign Application Priority Data

Mar. 28, 2002 (JP) ..... 2002-093155

(51) Int. Cl.
*B65D 85/00* (2006.01)

(52) U.S. Cl. ..... 206/320

(58) Field of Classification Search ..... 206/320
See application file for complete search history.

(56) References Cited

U.S. PATENT DOCUMENTS

| | | | | | |
|---|---|---|---|---|---|
| 2,132,632 | A | * | 10/1938 | Kondolf | 206/427 |
| 2,563,132 | A | * | 8/1951 | Paige | 229/120.22 |
| 4,522,303 | A | * | 6/1985 | Starr | 206/588 |
| 4,640,418 | A | * | 2/1987 | Lowry | 206/499 |
| 5,058,745 | A | * | 10/1991 | Warner et al. | 206/523 |
| 5,228,589 | A | * | 7/1993 | Della Riva | 206/229 |
| 5,501,339 | A | * | 3/1996 | Suzuki et al. | 206/586 |
| 5,641,068 | A | * | 6/1997 | Warner | 206/523 |
| 5,685,431 | A | * | 11/1997 | Chambers et al. | 206/521 |
| 6,092,654 | A | * | 7/2000 | Webb | 206/320 |
| 2003/0213725 | A1 | * | 11/2003 | Koike | 206/588 |

FOREIGN PATENT DOCUMENTS

| | | | | |
|---|---|---|---|---|
| JP | 54-113868 | S | | 9/1979 |
| JP | 5-046780 | U | | 6/1993 |
| JP | 5-051769 | U | | 7/1993 |
| JP | 8-276962 | A | | 10/1996 |
| JP | 9 99948 | | * | 4/1997 |
| JP | 10 7127 | | * | 1/1998 |
| JP | 11-157569 | A | | 6/1999 |
| JP | 2000-025549 | A | | 1/2000 |
| JP | 2000-033972 | A | | 2/2000 |
| JP | 2000-053123 | A | | 2/2000 |
| JP | 2000-255640 | A | | 9/2000 |
| JP | 2001341730 | A | * | 12/2001 |
| JP | 200326246 | A | * | 1/2003 |
| JP | 2003182788 | A | * | 7/2003 |

* cited by examiner

*Primary Examiner*—Eugene Kim
*Assistant Examiner*—Dolores R. Collins
(74) *Attorney, Agent, or Firm*—Oliff & Berridge, PLC

(57) ABSTRACT

The invention provides a packing article where a packing cost and a transportation fee can be kept low and a buffering function is further enhanced. The invention provides a packing article including: a packing box; a lower-side buffering member to provide packing including a concave portion, which is located at the lower side of the packing box, and which locates an item to be packed in the center; an item to be packed, located in the concave portion of the lower-side buffering member to provide packing; and a partition member located on the upper side of the item to be packed and a storing member, which is located between the partition member and the upper surface of the packing box, and which stores an attached part and/or an instruction manual. The partition member includes an outside partition member, including an upper surface member and an outside skirt portion connected to the upper surface member, and an inside partition member, including a lower surface member and an inside skirt portion connected to the lower surface member.

12 Claims, 16 Drawing Sheets

(a)

(b)

PACKING ARTICLE, A METHOD OF PACKING AND A PARTITION MEMBER

BACKGROUND OF THE INVENTION

1. Field of Invention

The present invention relates to a packing article where an item to be packed, such as an electronic device, is packed in a packing box, a method of packing an item to be packed, such as an electronic device, in a packing box, and a partition member which is preferably used for the above packing article.

2. Description of Related Art

In the related art, an electronic device or a precise instrument, such as a computer, a printer and/or a projector, can be stored in a packing box with a pair of upper and lower buffering members of packing, which is made of foaming plastic or pulp mold material. The related art also includes a packing article or a method of packing where a buffer member to provide packing, which is made of relatively expensive bubble resin material, is only used for buffering on a lower side and a tray for attached parts, and a box to store attached parts of a product is used to provide buffering on the upper side. This approach can reduce packing cost since the numbers of buffer members to provide packing is reduced to be half other techniques, and can reduce shipping cost since the size of a packing article is small.

FIG. 11 to FIG. 16 show a related art packing article and a method of packing. FIG. 11 is a cross-sectional view of a related art packing article where a box for attached parts is used for a buffer member on the upper side. As shown in FIG. 11, a related art packing article 700 includes a packing box 10, a lower pad 20 located on the bottom of a packing box 10, a lower-side buffering member to provide packing 30 having a concave portion in the center located on the upper surface of the lower pad 20, an item to be packed P located in the concave portion of the lower-side buffering member for packing 30, a box for attached parts 50 made of a corrugated cardboard and located on the upper side of the item to be packed P.

In a packing box 10, a handling opening 10C, to enhance gripping with a user's hand at the time of carrying the packing box, and a throwing opening 10D to enable passage therethrough of an additional part P2 or an additional instruction manual M2 therein in a shipped area (such as a foreign country), are installed.

FIG. 12 is a schematic that shows a packing method of the related art packing article shown in FIG. 11. The related art packing article 700 is packed as follows. Firstly, the lower pad 20 is located on the lower surface of the packing box 10 The lower-side buffering member 30 having a concave portion in its center is located on the upper surface of the lower pad 20 thereafter. The item to be packed P is located in the concave portion of the lower-side buffering member for packing 30 thereafter. A box for attached parts 50, which is made of a corrugated cardboard and stored attached parts and instruction manuals in advance, is located on the upper surface of this item to be packed P. A lid of the packing box is closed, thereby forming the packing article 700.

Therefore, in the related art packing article, the box for attached parts 50 made of a corrugated cardboard is located on the upper side of the item to be packed P so that shockproof is secured by buffer function between the lower-side buffering member for packing 30 and the box for attached parts 50 and the packing article is shipped to the destination safely, even if this article is dropped on the way.

FIG. 13 is a cross-sectional view of a related art packing article where a tray for attached parts is used as a buffering member at upper side. As shown in FIG. 13, a related art article 800 includes a packing box 10, a lower pad 20 located in the bottom of the packing box 10, a lower-side buffering member 30 having a concave portion in the center located on the upper surface of the lower pad 20, the item to be packed P located in the concave portion of the lower-side buffering member 30, a tray for attached parts 52 made of a corrugated cardboard and located on the upper side of the item to be packed P. An attached part P1 and an instruction manual M1 are stored in the inside of the tray 52.

In the packing box 10, a handle opening 10C, to enhance gripping with a user's hand at the time of carrying the packing box, and a throwing opening 10D, to enable passage therethrough of an additional part P2 or an additional instruction manual M2 therein at a shipped area (such as a foreign country), are installed.

FIG. 14 is a schematic of a packing method of a related art packing article shown in FIG. 13. The related art packing article 800 is packed as follows. Firstly, the lower pad 20 is located on the lower surface of the packing box 10. The lower-side buffering member to provide packing 30 having a concave portion in its center is located on the upper surface of the lower pad 20 thereafter. The item to be packed P is located in the concave portion of the lower-side buffering member 30 thereafter. A tray for attached parts 52, made of a corrugated cardboard and stored attached parts and instruction manuals in advance, is located on the upper surface of this item to be packed P. The lids of the packing box are closed, thereby forming the packing article 800.

Thus, in the related art packing article, the tray for attached parts 52 made of a corrugated cardboard and located on the upper side of the item to be packed P so that shockproof is secured by buffer function between the lower-side buffering member 30 and the box for attached parts 50 and the packing article is shipped to the destination safely, even if this article is dropped on the way.

FIG. 15 is a cross-sectional view of a related art packing article where a partition plate is installed. As shown in FIG. 15, a related art article 900 includes the packing box 10, a reinforcing spacer 22 located on the bottom of a packing box 10, the lower-side buffering member to provide 32 having a concave portion in the center located on the upper surface of the reinforcing spacer 22, the item to be packed P located in the concave portion of the a lower-side buffering member for packing 30, a partition member 40 including a partition plate 42 (see FIG. 16) and a skirt portion 44 (see FIG. 16) and a box 50 for attached parts, which is made of a corrugated cardboard and located at the upper side of the partition member 40. An attached part P1 and an instruction manual M1 are stored in the inside of the box 50 for attached parts.

In the packing box 10, the handling opening 10C, to enhance gripping with a user's hand at the time of carrying the packing box, and the throwing opening 10D, to enable passage therethrough of an additional part P2 or an additional instruction manual M2 therein at a shipped area (such as a foreign country), are installed.

FIG. 16 is a schematic of a packing method of a related art packing article shown in FIG. 15. The related art packing article 900 is packed as follows. Firstly, the reinforcing spacer 22 is inserted under the lower side of the lower-side buffering member to provide 32 having a concave portion in the center. This lower-side buffering member 32 with the inserted reinforcing spacer 22 is located on the bottom of the packing box 10. The item to be packed P is located in the concave portion of the lower-side buffering member 32 thereafter. The partition member 40 including the partition plate 42 and the skirt portion 44 connected to the partition plate 42 is located on the upper side of the item to be packed P thereafter. A box for attached parts 50, made of a corrugated cardboard and stored attached parts and instruction manuals in advance, is located on the upper surface of this partition member 40. The lids of the packing box are closed, thereby forming the packing article 900.

Thus, in the related art packing article, the box for attached parts 50, which is made of a corrugated cardboard, works as the upper buffer member and is located on the upper surface of the item to be packed P so that shockproof is highly secured by buffering function of the lower-side buffering member for packing 32 and the box for attached parts 50 and the packing article is shipped safely, even if the packing article is dropped on the way. Further, in this related art packing article, the partition member 40 is located between the item to be packed P and the box for attached parts 50 so that this item to be packed P contacts with the box for attached parts 50 via this partition member, even if the item to be packed P is thick. Hence, shockproofing is provided by the buffering function of this partition member, and the packing article is shipped safely, even if the packing article is dropped on the way. Further, the shock to the packing article P, caused by the weight of the box for attached parts 50, can be softened because of the existence of the partition member 40.

A box for attached parts and a tray for attached parts made of corrugated cardboard and used in the related art packing article are subject to the problem that these elements are still hard, and thus somewhat insufficient to achieve a buffering function. Further, the partition member is also still hard, and thus somewhat insufficient to achieve a buffering function, even if installing the partition member enhances the buffering function.

SUMMARY OF THE INVENTION

Therefore, the present invention addresses or solves above, and provides a packing article where a packing cost and a transportation fee can be reduced, and a buffering function is further enhanced. Further, the present invention provides a method of packing utilizing the packing article. Further, the present invention provides a partition member which is used for the packing article.

(1) The packing article of an exemplary embodiment of the present invention includes: a packing box, a lower-side buffering member to provide packing including a concave portion, which is located on the bottom of the packing box, and which locates an item to be packed in the center, the item to be packed, which is located in the concave portion of the lower-side buffering member for packing, a partition member located on the upper side of the item to be packed, and a storing member, which is located between the partition member and the upper surface of the packing box, and which stores an attached part or an instruction manual. The partition member includes an outside partition member, including an upper surface member and an outside skirt portion connected to the upper surface member, and an inside partition member, including a lower surface member and an inside skirt portion connected to the lower surface member.

In accordance with this structure, the packing article in the present invention includes the partition member, instead of a related art partition member, including an outside partition member, including an upper surface member and an outside skirt portion connected to the upper surface member, and an inside partition member, including a lower surface member and an inside skirt portion connected to the lower surface member. Hence, the number of buffering members to provide packing, which are made of relatively expensive bubble resin, can be reduced to half of that of the related art, so that a packing cost is reduced and a transportation fee is also reduced since the volume of a packing article is small. Further, a buffering function is enhanced by interaction between the outside partition member and the inside partition member.

(2) It is preferable that said partition member is made of corrugated cardboard in the above-mentioned packing article (1).

In accordance with this structure, the feature of buffering function of corrugated cardboard can be demonstrated and shockproof on the packing article is reinforced.

(3) It is preferable that the partition member includes a protrusion, in the above-mentioned packing article (2), which is formed by: cutting a part of a ridgeline of a bent portion of the inside partition member, and bumping the upper surface member of the outside partition member so that the buffering function can be enhanced.

In accordance with this structure, shock is softened at the protrusion located between the outside partition and the inside partition member, even if the packing article is dropped from the upper surface or the lower surface. Hence, shock transmitted to the packing article is effectively softened and shockproofing is enhanced thereby.

(4) It is preferable that the partition member includes a protrusion, in the above-mentioned packing article (2), which is formed by: cutting a part of a ridgeline of a bent portion of the inside partition member, and bumping the outside skirt portion of the outside partition member so that a buffering function can be enhanced.

In accordance with this structure, shock is softened at the protrusion located between the outside skirt portion and the inside partition member, even if the packing article is dropped from the side surface. Hence, shock transmitted to the packing article is effectively softened, and shockproofing is enhanced thereby.

(5) It is preferable that the partition member includes a protrusion, in the above-mentioned packing article (2), which is formed by: cutting a part of a ridgeline of a bent portion of the outside partition member, and bumping the side of the packing box so that a buffering function can be enhanced.

In accordance with this structure, shock is softened at the protrusion located between the outside partition member and the side of said packing box, even if the packing article is dropped from the side surface. Hence, shock transmitted to the packing article is effectively softened, and shockproofing is enhanced thereby.

(6) It is preferable that the mesh direction of the corrugated cardboard at the protrusion is parallel with the protruded direction of said protrusion, in the above-mentioned packing article (3) to (5).

In accordance with this structure, shock is effectively softened at a protruded area of the protrusion, when such protrusion is crushed to the protruded direction. Hence, shockproofing of the packing article is enhanced thereby.

(7) It is preferable that said outside partition member is intergraded with the inside partition, in the above-mentioned packing article (1).

In accordance with this structure, the number of parts including the partition member can be reduced or minimized, and workability of packing is enhanced.

(8) The outside partition member can be separated from the inside partition, in the above-mentioned packing article (1).

In accordance with this structure, the size of parts including the partition member can be small, and the effect of using the materials is enhanced.

(9) It is preferable that the above-mentioned packing article (1) includes the throwing opening to enable passage therethrough of an additional part and/or an additional document (an additional part and others hereunder) after closing the packing article, and the opening in the partition member to store the additional part and others.

In accordance with this structure, there is the opening in the partition member between the storing member of the upper buffer member to store an additional part and others and the throwing opening to enable passage therethrough of an additional part and others so that there is no obstacle when an additional part and others are thrown therein at the shipped site.

(10) It is preferable that the upper surface member of the outside partition member of the partition member includes an opening in the center.

In accordance with this structure, the partition member is further softened and a buffering function is enhanced.

(11) It is preferable that the storing member to store an additional part and others is made of a corrugated cardboard in the above-mentioned packing article (1).

In accordance with this structure, the feature of buffering function of corrugated cardboard can be demonstrated, and shockproofing of the packing article is enhanced.

(12) It is preferable that the lower-side buffering member for packing is made of pulp mold material or bubble resin material.

In accordance with this structure, a sufficient buffering feature can be obtained. Especially, pulp mold material is superior viewed from recycling a vessel and a package.

(13) The method of packing on the present invention includes: locating a lower-side buffering member to provide packing including a concave portion at the lower side of the packing box, locating an item to be packed in the concave portion of the lower-side buffering member, locating a partition member at the upper side of the item to be packed, which includes an outside partition member, including an upper surface member and an outside skirt portion connected to the upper surface member, and an inside partition member, including a lower surface member and an inside skirt portion connected to the lower surface member, locating a storing member to store an additional parts and/or an additional instruction manual at the upper side of the partition member and closing the lid of the packing article.

The method of packing on the present invention provides a partition member, instead of a related art partition member, including the outside partition member, including the upper surface member and the outside skirt portion connected to the upper surface member, and the inside partition member, including the lower surface member and the inside skirt portion connected to the lower surface member. Hence, the number of buffering members to provide packing, which are made of relatively expensive bubble resin, can be half that of the related art so that a packing cost is reduced and a transportation fee is also reduced since the volume of a packing article is small. Further, a buffering function is enhanced by interaction between the outside partition member and the inside partition member.

(14) A partition member of the present invention is used for the above-mentioned packing box (1) and located between said product and the storing member to store attached parts and others, so that a buffering function is enhanced.

In accordance with this structure, the partition member of the present invention realizes a superior packing article as above-mentioned.

DETAILED DESCRIPTION OF PREFERRED EMBODIMENTS

[Embodiment 1]

Figure 1:
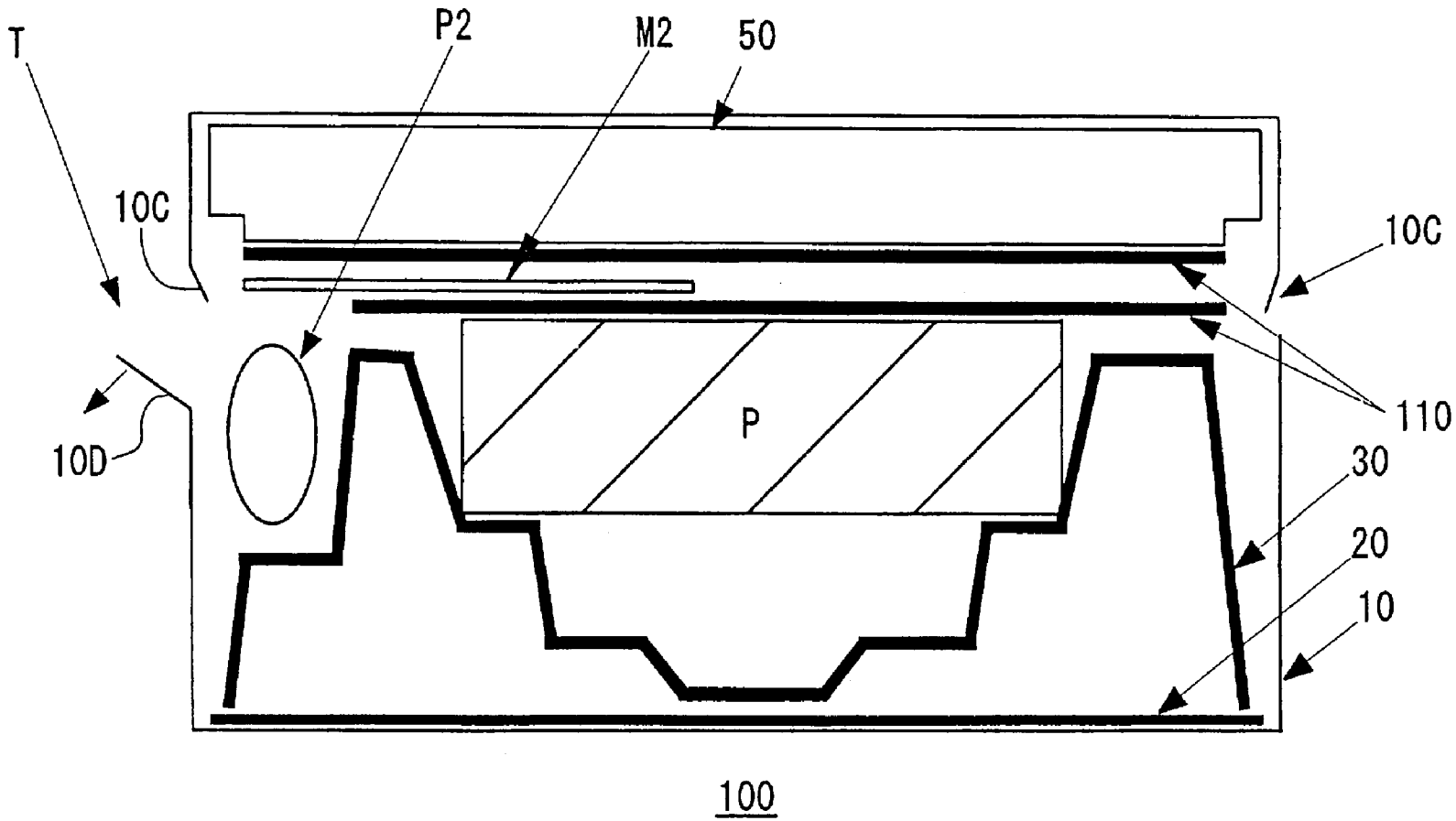
FIG. 1 is a cross-sectional view of a packing article in accordance with exemplary embodiment 1.
Figure 2:
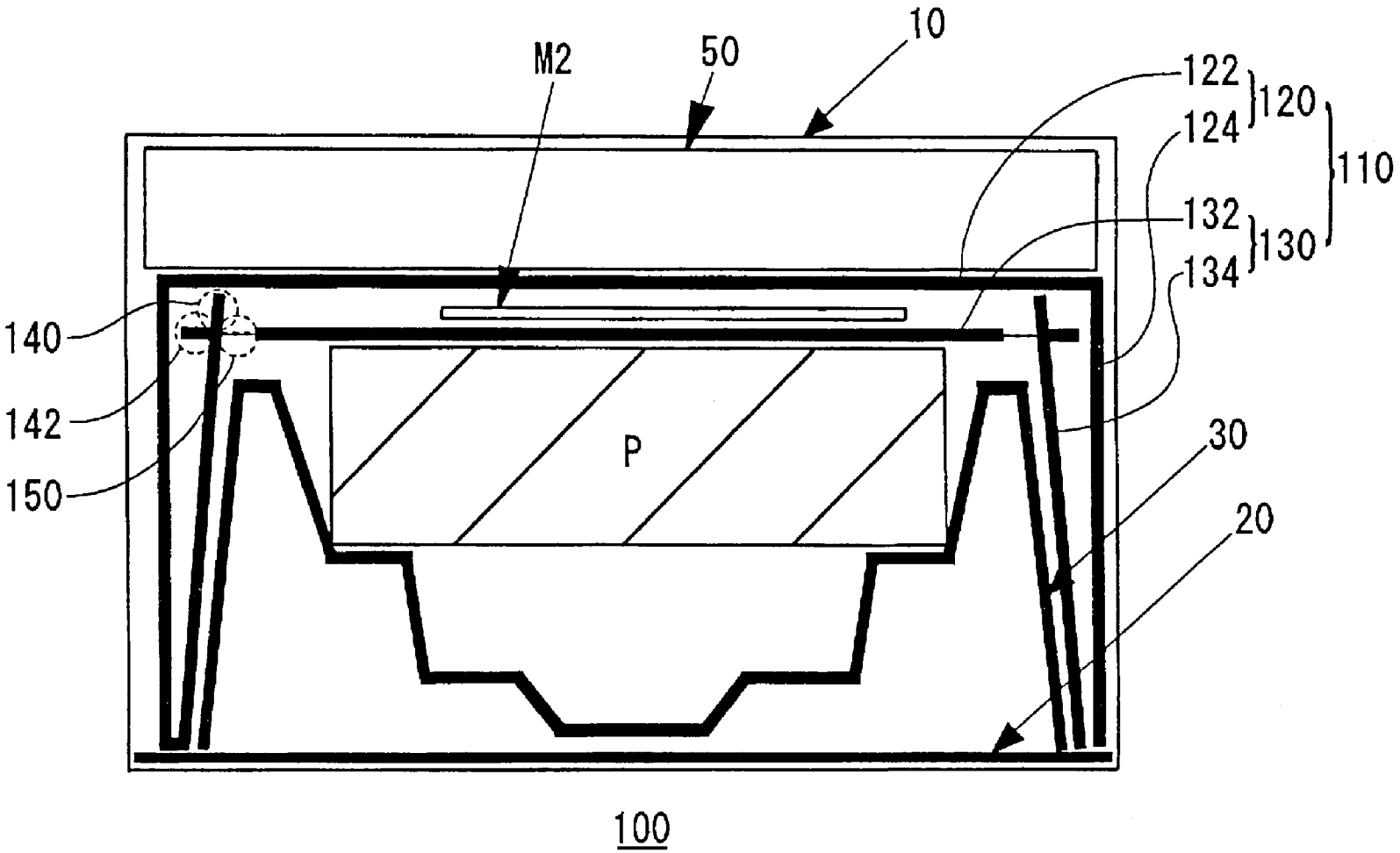
FIG. 2 is a cross-sectional view of the packing article according to exemplary embodiment 1.

FIG. 1 and FIG. 2 show a packing article in accordance with exemplary embodiment 1 of the present invention. FIG. 1 is a cross-sectional view from the longitudinal direction. FIG. 2 is a cross-sectional view from the side direction. As shown in FIG. 1 and FIG. 2, a packing article 100 includes a packing box 10, a lower-side buffering member to provide packing 30 including a concave portion, which is located at the lower side of the packing box, locates an item to be packed in the center, an item to be packed P located in the concave portion of the lower-side buffering member 30, a partition member 110 located at the upper side of the item to be packed and a storing member 50, which is located between the partition member 110 and the top surface of the packing box 10, stores an attached part and/or an instruction manual. A lower pad 20 is installed under the lower-side buffering member 30.

Figure 3:
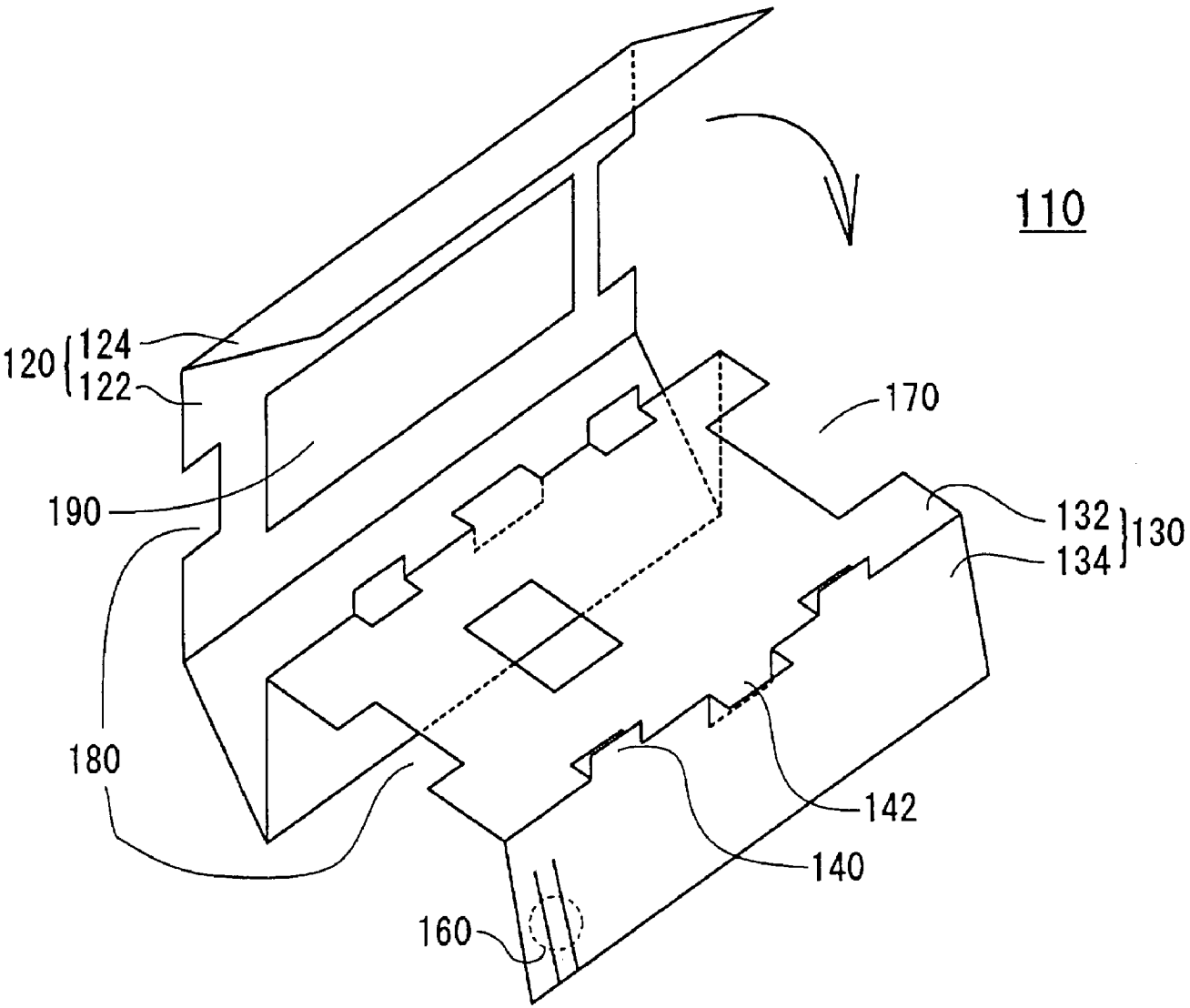
FIG. 3 is a schematic perspective view of the partition member according to exemplary embodiment 1.

FIG. 3 is a schematic of the partition member 110 in accordance with exemplary embodiment 1 of the present invention. As shown in FIG. 2 and FIG. 3, the partition member 110 includes an outside partition member 120 including an upper surface member 122 and an outside skirt portion 124 connected to the both sides of the upper surface member 122 and an inside partition member 130 including a lower surface member 132 and an inside skirt portion 134 connected to the both sides of the lower surface member 132. The outside partition member 120 is integrated with the inside partition member 130 so that workability of packing is enhanced.

The packing article 100 in accordance with exemplary embodiment 1 includes the above-mentioned partition member 110 instead of the related art mentioned partition member 40 so that a packing cost can be reduced since the number of buffer members to provide packing, such as expensive bubble resin material, and a transportation cost can also be reduced since the volume of packing article is small. Further, buffer function is enhanced by mutual reaction between the outside partition member 120 and the inside partition member 130.

In this packing article 100, the partition member 110 is made of corrugated cardboard. Thus, a buffer function of this corrugated cardboard is demonstrated and shockproofing of a packing article is sufficiently enhanced.

In this packing article 100, the partition member 110 has four protrusions 140. The protrusions 140 are formed by cutting a part of a ridgeline of the bent portion of the inside partition member 130. Further, this bumps with the upper surface member 122 of the outside partition portion 120 so as to reinforce the buffer function. Thus, shock is softened by the protrusion 140 located between the outside partition member 120 and the inside partition member 130, even if this packing article 100 is dropped from the bottom or the top, so that the shock to the item to be packed P can be effectively softened. Shockproofing of the packing article 100 can be fairly enhanced thereby.

Further, in this packing article 100, the partition member 110 has the two protrusions 142. This protrusions 142 are formed by cutting a part of the ridgeline of the bent portion of the inside partition member 130 and bumps the outside skirt portion 124 of the outside partition portion 120 so as to reinforce a buffer function. Thus, shock is softened by the protrusions 142 located between the inside partition member 130 and the outside skirt portion 124, even if this packing article 100 is dropped from the side, so that the shock to the item to be packed P can be effectively softened. Shockproofing of the packing article 100 can be fairly enhanced thereby.

Figure 4:
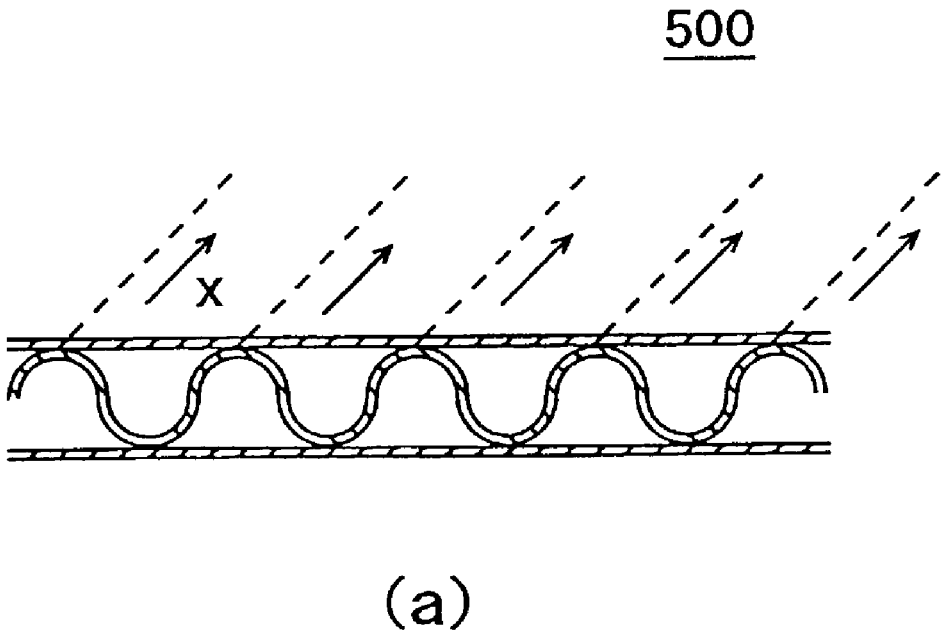
FIGS. 4(*a*) and 4(*b*) are cross-sectional views of a corrugated cardboard.
Figure 4:
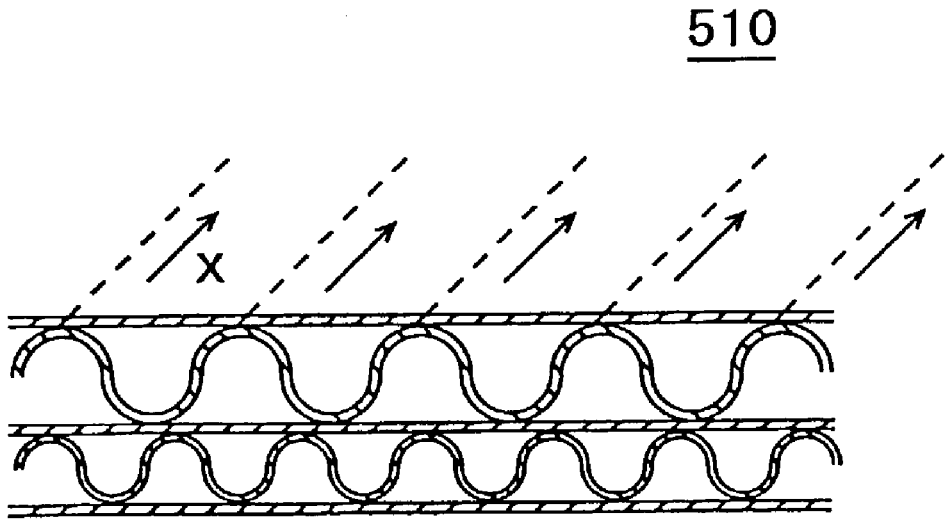

FIGS. 4(*a*) and 4(*b*) are partial cross-sectional views of corrugated cardboard. As shown in FIGS. 4(*a*) and 4(*b*), the mesh direction of corrugated cardboard is indicated as X direction in corrugated cardboard 500 and 510.

In this packing article 100, the mesh direction 160 of the corrugated cardboard at the protrusions 140 and 142 is located in parallel with protruded direction of them. Thus, shock is softened at the area where these protrusion bump, when the protrusions are crushed to the protruded direction. Shockproofing can be reinforced thereby.

In this packing article 100, a throwing opening 10D where additional parts P2 and/or additional documents M2 (an additional part and others thereafter) can be passed therethrough after closing the packing box 10, are installed (See FIG. 1). Further, the partition member 110 includes the opening 170 where additional parts can be stored therein (See FIG. 3). Thus, there is the opening 170 of the partition member 110 between the throwing opening 10D for additional parts P2 and the storing member of partition member 110 (the space between the upper surface member and the lower surface member) to store additional parts. There is no obstacle when additional parts P2 are thrown at the shipped site thereby (See FIG. 1).

In this packing article 100, there is an opening 190 at the central portion of the upper surface member 122 in the outside partition member 120 of the partition member 110. Thus, the partition member 110 is further softened, and shockproofing is enhanced thereby.

In this packing article 100, the box for additional parts 50 is made of corrugated cardboard. Thus, buffer function of the corrugated cardboard can be demonstrated, and shockproofing is reinforced in the packing box. Further, in this packing article 100, the lower-side buffering member 30 is made of pulp mold material. Thus, sufficient buffering can be attained, and it is effective to recycling a vessel and a package.

Figure 5:
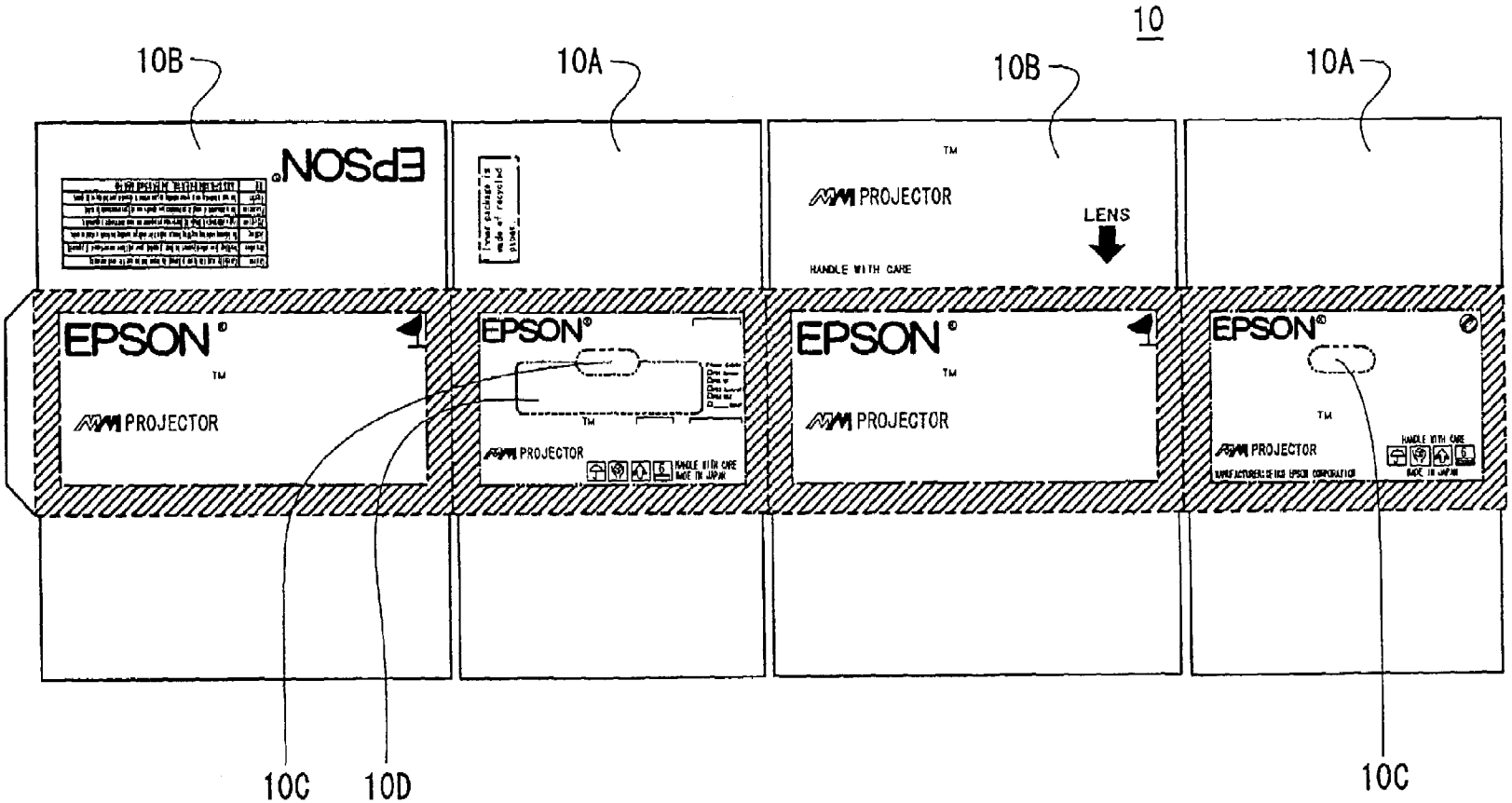
FIG. 5 is a schematic of the packing article according to exemplary embodiment 1.

FIG. 5 is a schematic of the packing article 10 in accordance with exemplary embodiment 1. As shown in FIG. 5, the packing box 50 includes an inside flap 10A, an outside flap 10B, a handling opening 10C and a throwing opening for parts 10D.

Figure 6:
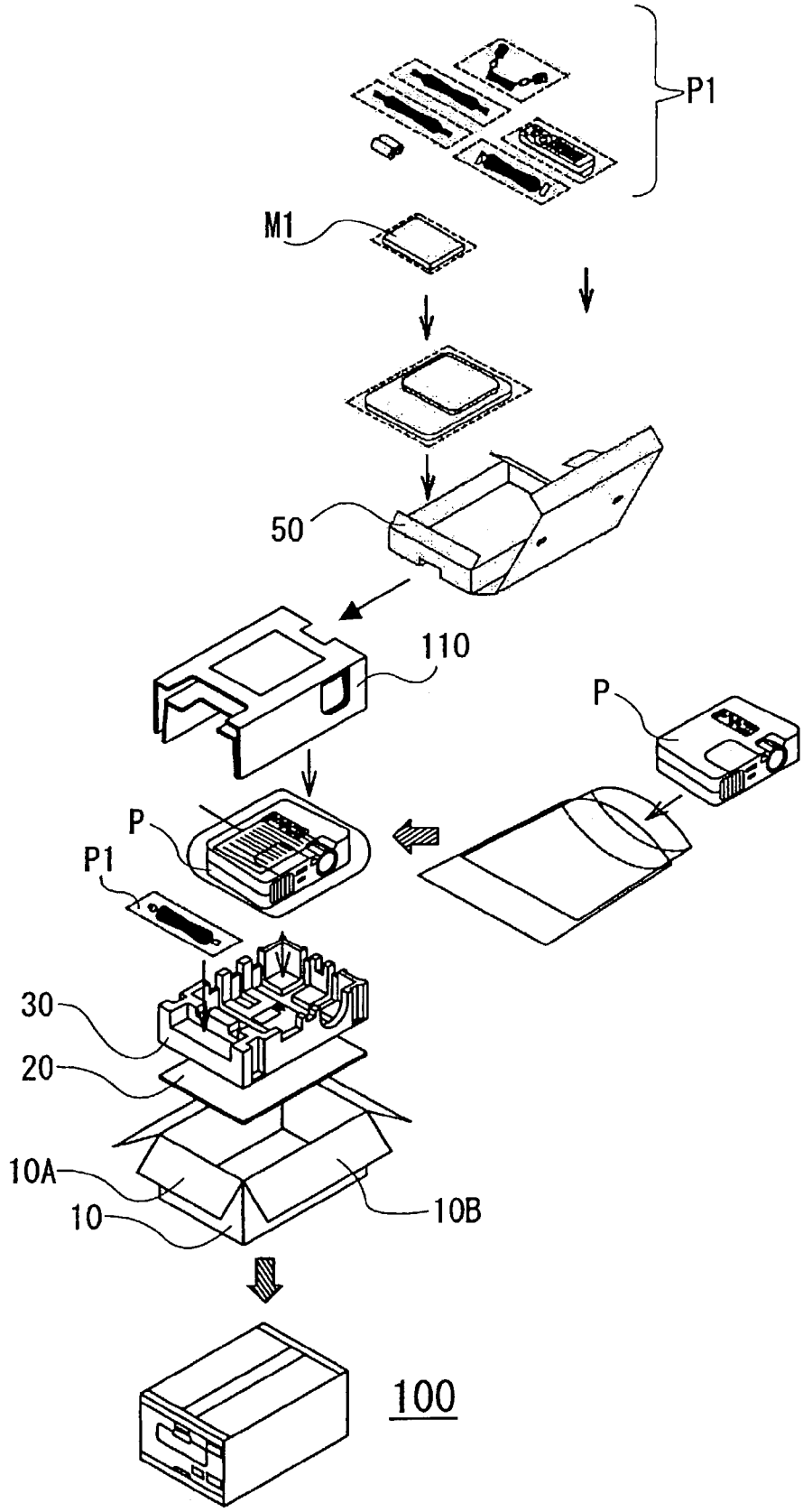
FIG. 6 is a schematic showing assembling of the packing article according to exemplary embodiment 1.

A method of packing in accordance with exemplary embodiment 1 is shown in FIG. 6. Firstly, the lower pad 20 is located at the lower part of the packing box 10. The lower buffering member to provide packing 30 having a concave portion in the center is located on the upper surface of the lower pad 20 thereafter. The item to be packed P is located in the convex portion of the lower buffering member 30 thereafter. The partition member 110 is located at the upper side of the packed article P thereafter. The box for attached parts 50, which stores necessary parts P1 and/or instruction manual M1, is located at the upper surface of the partition member 110. The lids 10A and 10B of the packing box are finally closed. Here, the attached parts P1 are also stored in the storing portion of the lower buffering member 30 in FIG. 6.

This exemplary method of packing utilizes the above-mentioned partition member 110, instead of a related art partition member 40, so that the number of buffering members to provide packing, which are made of relatively expensive bubble resin, can be half of that of the related art. Thus, a packing cost is reduced and a transportation fee is also reduced thereby since the volume of a packing article is small. Further, a buffering function is enhanced by interaction between the outside partition member 120 and the inside partition member 130.

The partition member 110 in accordance with exemplary embodiment 1 is preferable to achieve a superior packing article 100.

[Embodiment 2]

Figure 7:
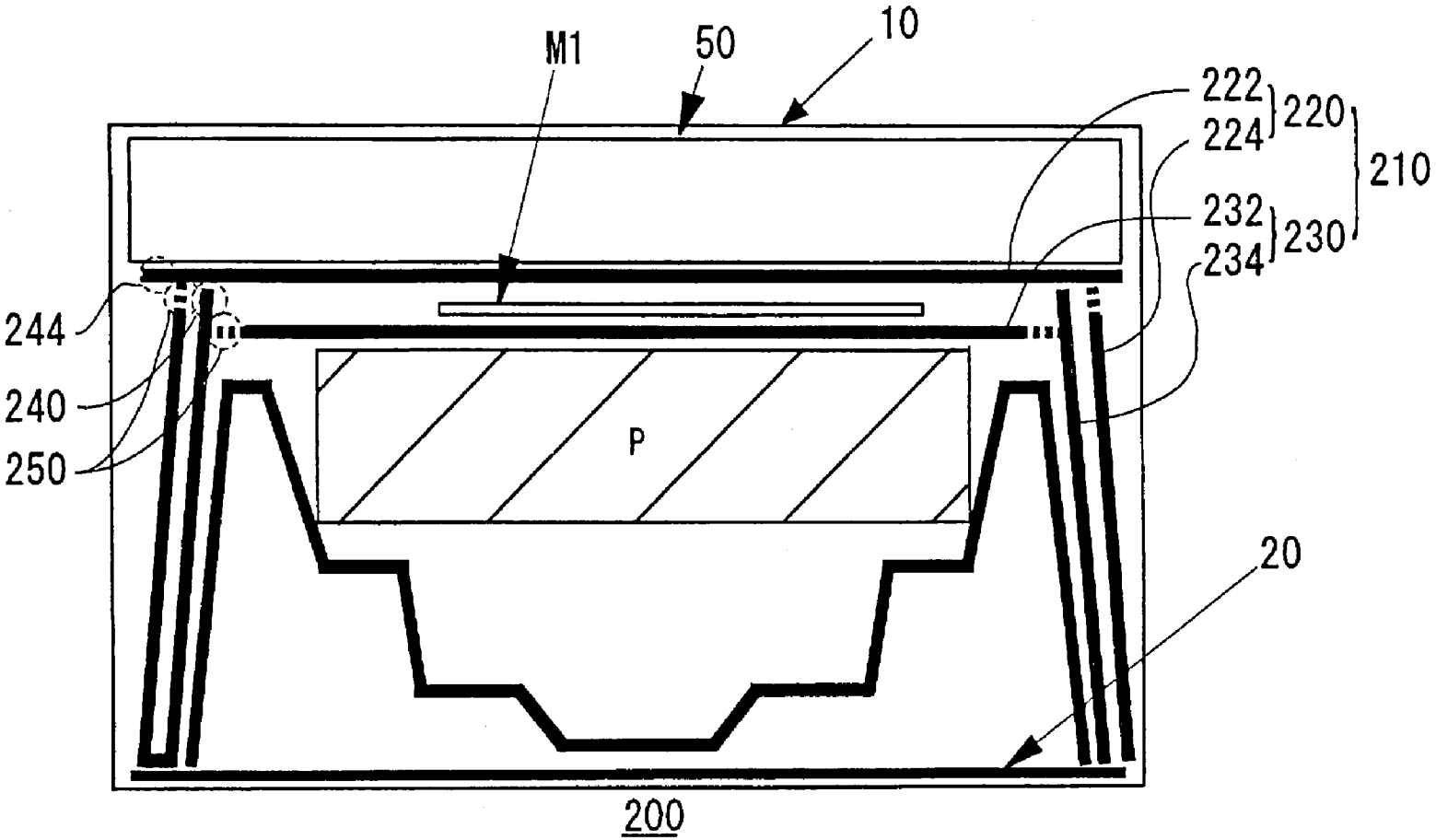
FIG. 7 is a cross-sectional view of the packing article in accordance with exemplary embodiment 2.
Figure 8:
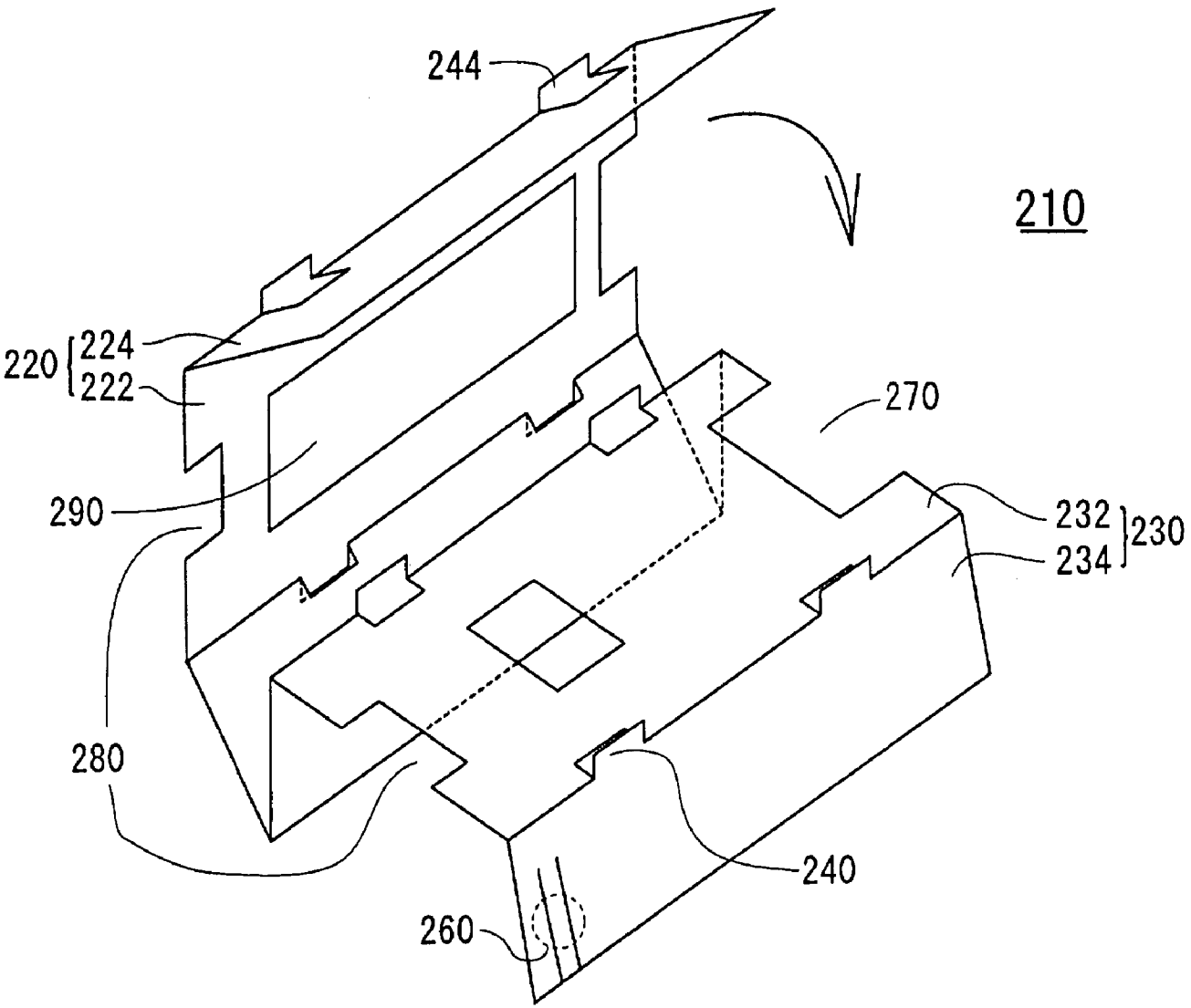
FIG. 8 is a schematic perspective view of the partition member according to exemplary embodiment 2.
Figure 9:
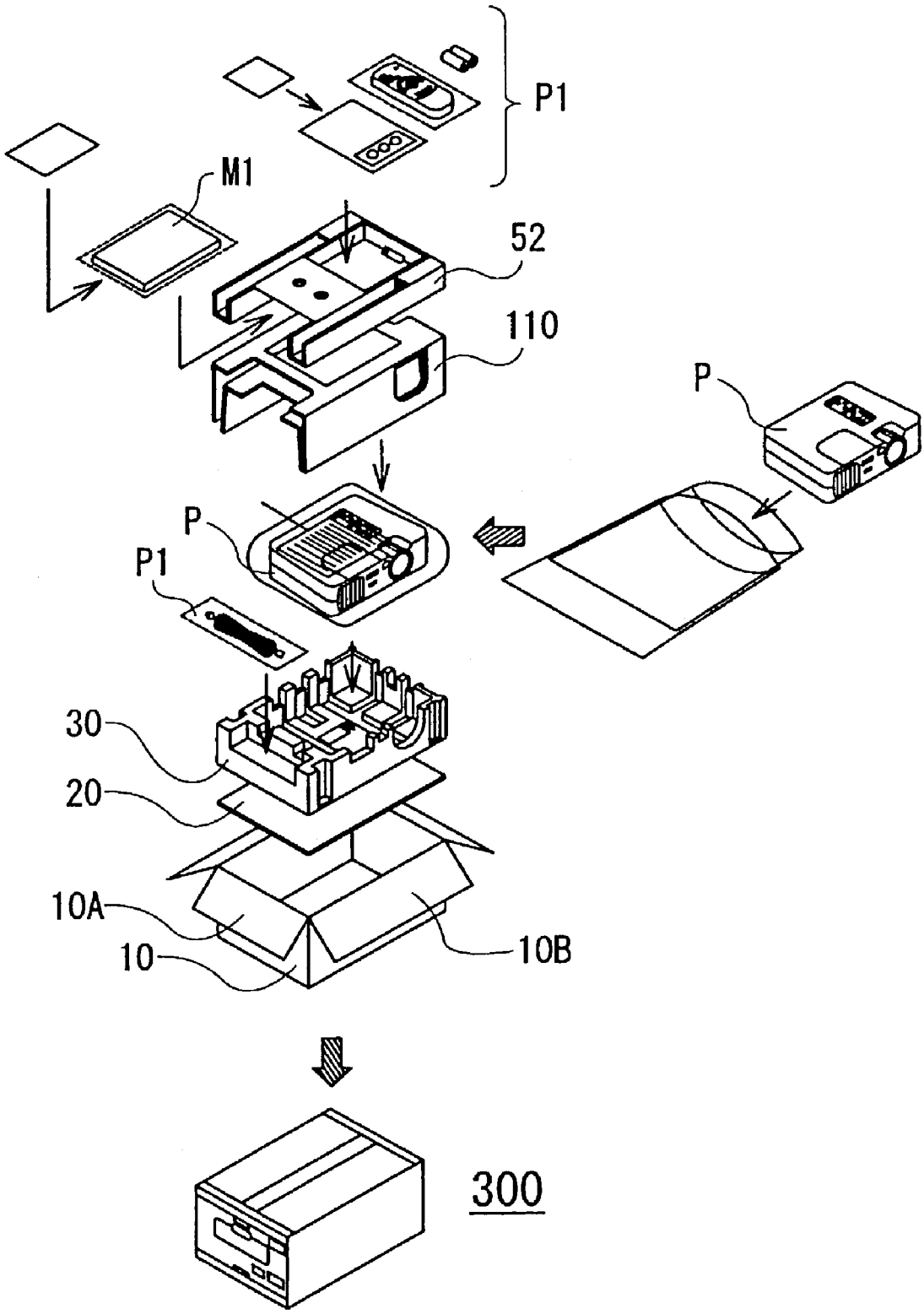
FIG. 9 is a schematic showing development of the packing article in accordance with exemplary embodiment 3.

FIG. 7 is a schematic that shows a packing article 200 in accordance with exemplary embodiment 2 of the present invention. FIG. 8 is a schematic of a partition member 210 according to exemplary embodiment 2. As shown in FIG. 8 and FIG. 9, the partition member 210 according to exemplary embodiment 2 has basically the same structure as the partition member 110 of exemplary embodiment 1. Namely, the partition member 210 of embodiment 2 includes an outside partition member 220 including an upper surface member 222, and an outside skirt portion 224 connected to the upper surface member 222, and an inside partition member 230 including a lower surface member 232 and an inside skirt portion 234 connected to the lower surface member 232.

The structure of the packing article 200 according to exemplary embodiment 2 utilizes the above mentioned partitioning member 210, instead of a related art partition member 40, so that the number of buffering members to provide packing, which are made of relatively expensive bubble resin, can be half of that of the related art. Thus, a packing cost is reduced and a transportation fee is also reduced since the volume of a packing article is small. Further, buffering function is further enhanced by interaction between the outside partition member 220 and the inside partition member 230.

The difference between the partition member 110 of exemplary embodiment 1 and the partition member 210 of exemplary embodiment 2 is a protrusion. Namely, the partition member 110 of embodiment 1 has the protrusion 140, which is formed by: cutting a part of a ridgeline of a bent portion of the inside partition member 130, and bumping the upper surface member 122 of the outside partition member 120 so as to enhance a buffering function, and the protrusion 142, which is formed by: cutting a part of a ridgeline of a bent portion of the inside partition member 130, and bumping the outside skirt portion 124 of the outside partition member 120 so as to enhance a buffering function.

On the other hand, the partition member 210 of exemplary embodiment 2 has a protrusion 240, which is formed by: cutting a part of a ridgeline of a bent portion of an inside partition member 230, and bumping an upper surface member 222 of an outside partition member 220 so as to enhance a buffering function and a protrusion 244, which is formed by: cutting a part of a ridgeline of a bent portion of an outside partition member 220, and bumping the side of the packing article 10 so as to enhance a buffering function.

Therefore, shock is softened by the protrusion 240 located between the outside partition member 220 and the inside partition member 230 as well as the case of the partition member 110, if the packing article 200 is dropped from the bottom or top surface, so that shock transmitted to the packed article P can be effectively softened. Shockproofing the packing article 200 can be enhanced thereby.

Further, in this packing article 200, shock is softened by the protrusion 244 between the outside skirt portion 224 of the outside partition member 220 and the side of the packing article 10, though the position of the protrusion is different from that of the exemplary embodiment 1, when this article is dropped from the side, so that that shock transmitted to the packed article P can be effectively softened. Shockproofing the packing article 200 can be enhanced thereby.

[Embodiment 3]

FIG. 9 is a schematic that shows assembling process of packing article of exemplary embodiment 3 of the present invention. The difference between the packing article 300 of exemplary embodiment 3 and the packing article 100 of exemplary embodiment 1 is a portion to store attached parts. Namely, a portion to store attached parts of the packing article 100 of exemplary embodiment 1 is a box for attached parts 50. On the other hand, a portion to store attached parts of the packing article 100 of exemplary embodiment 1 is a tray for attached parts 52. The packing article 300 of exemplary embodiment 3 is basically the same of the packing article 100 of exemplary embodiment 1 except for the above-mentioned structure. The packing article 300 of exemplary embodiment 3 includes the partition member 110 as well as the packing article 100 of exemplary embodiment 1.

By assembling of the packing article 300 of exemplary embodiment 3, the number of buffering members to provide packing, which are made of relatively expensive bubble resin, can be reduced to half. Thus, a packing cost is reduced and a transportation fee is also reduced thereby since the volume of a packing article is small. Further, a buffering function is enhanced by interaction between the outside partition member 120 and the inside partition member 130 as well as exemplary embodiment 1.

[Embodiment 4]

Figure 10:
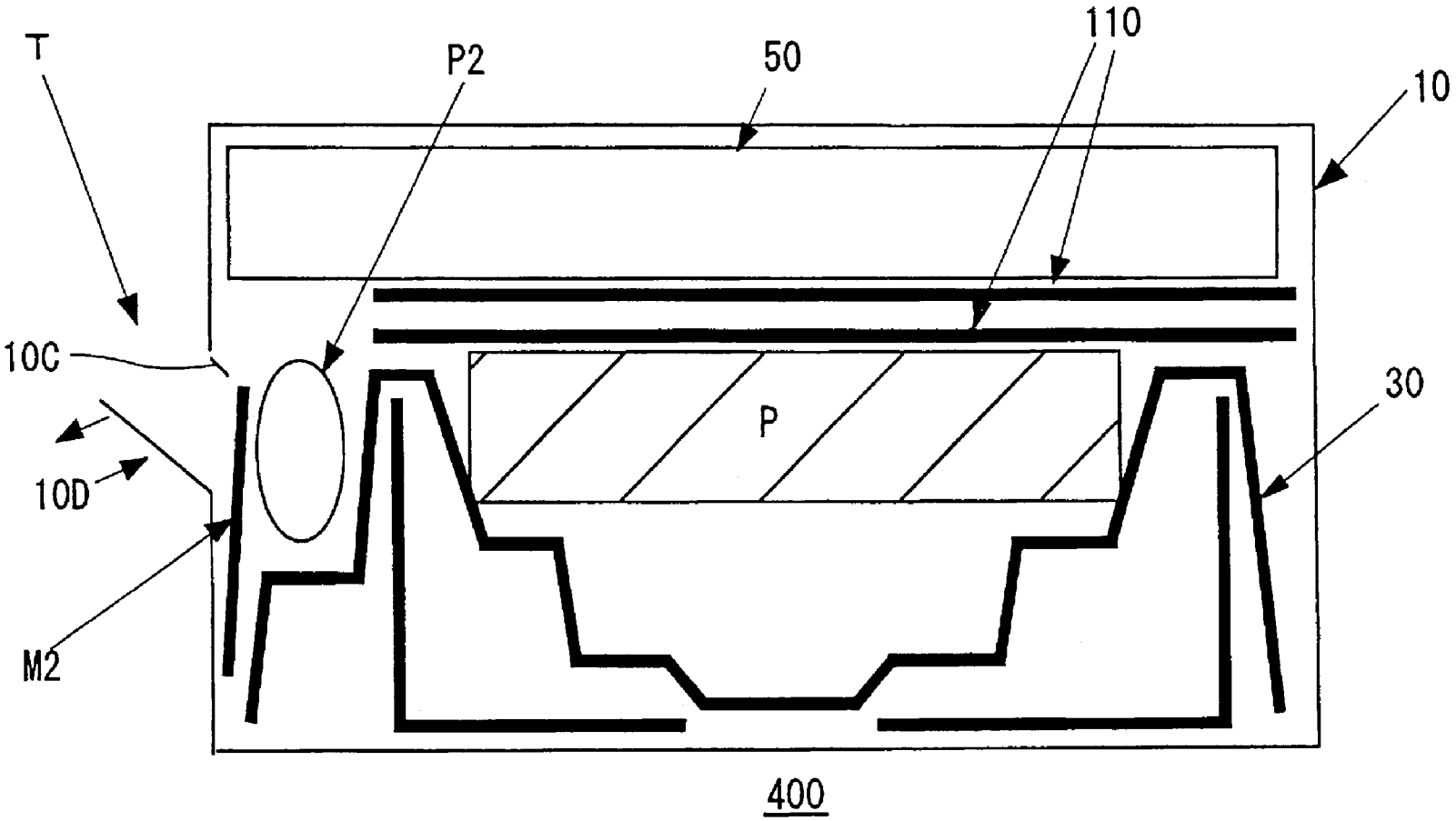
FIG. 10 is a cross-sectional view of the packing article in accordance with exemplary embodiment 4.
Figure 11:
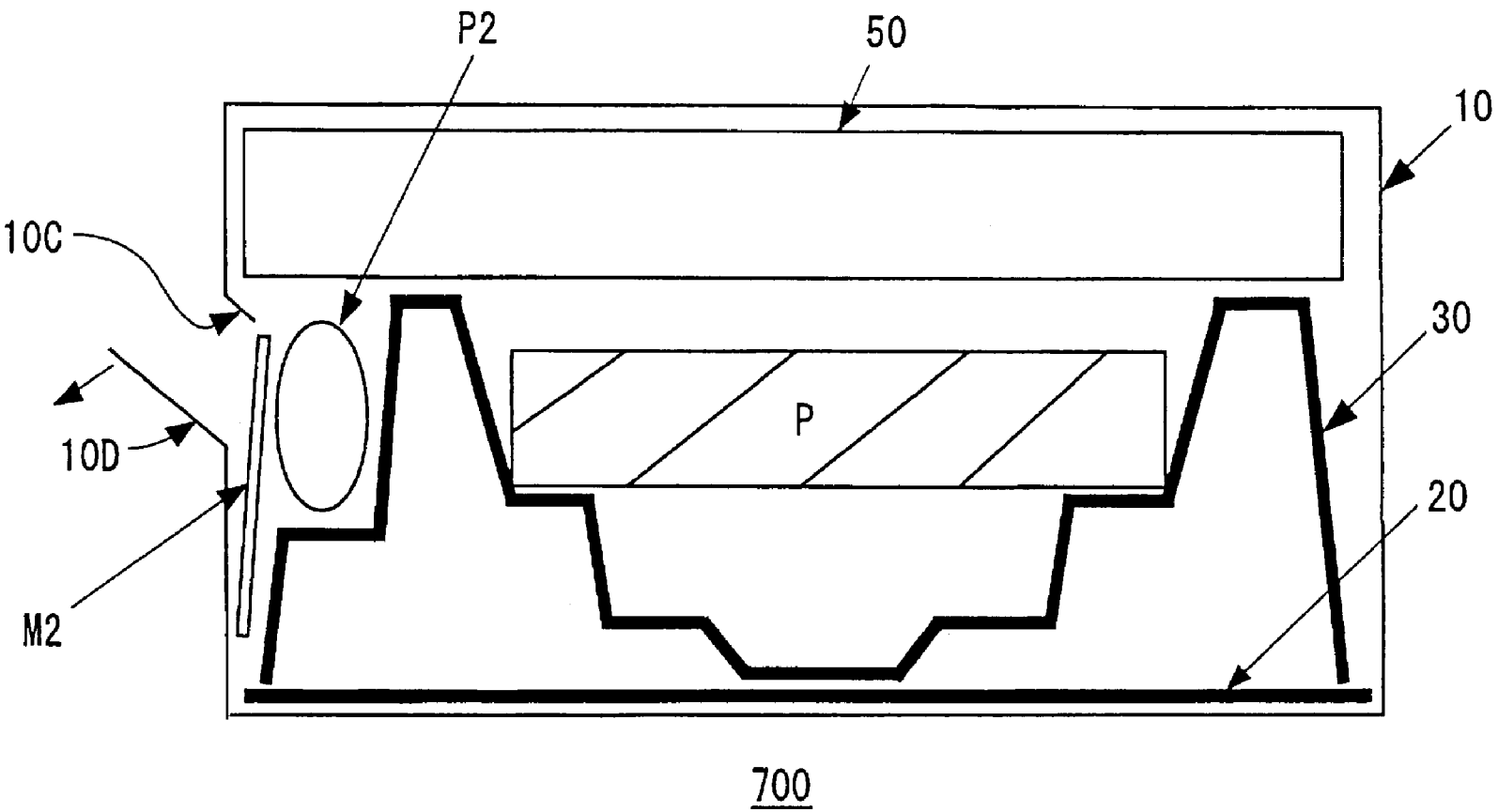
FIG. 11 is a cross-sectional view of a related art packing article.
Figure 12:
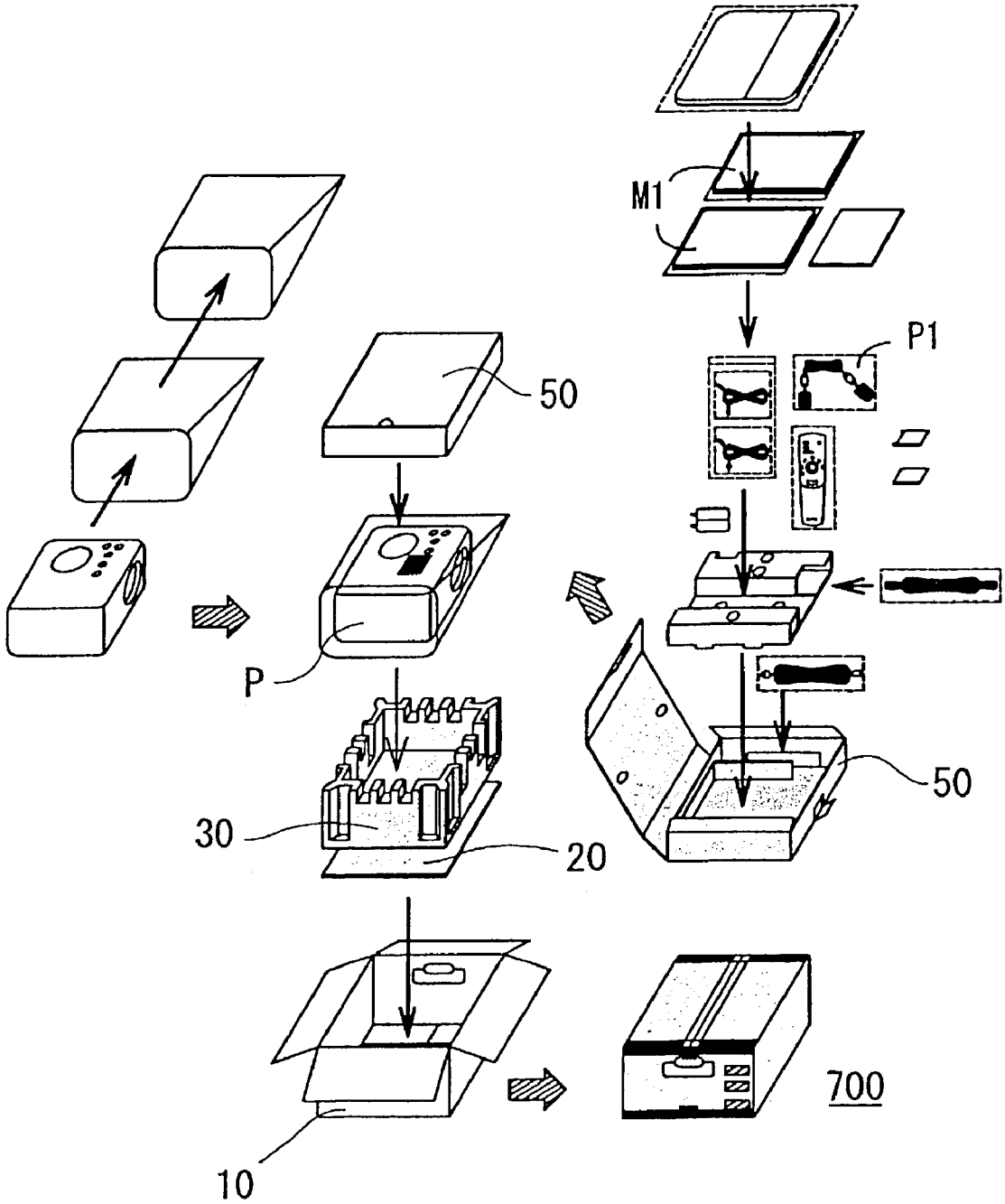
FIG. 12 is a schematic that shows assembling of the related art packing article.
Figure 13:
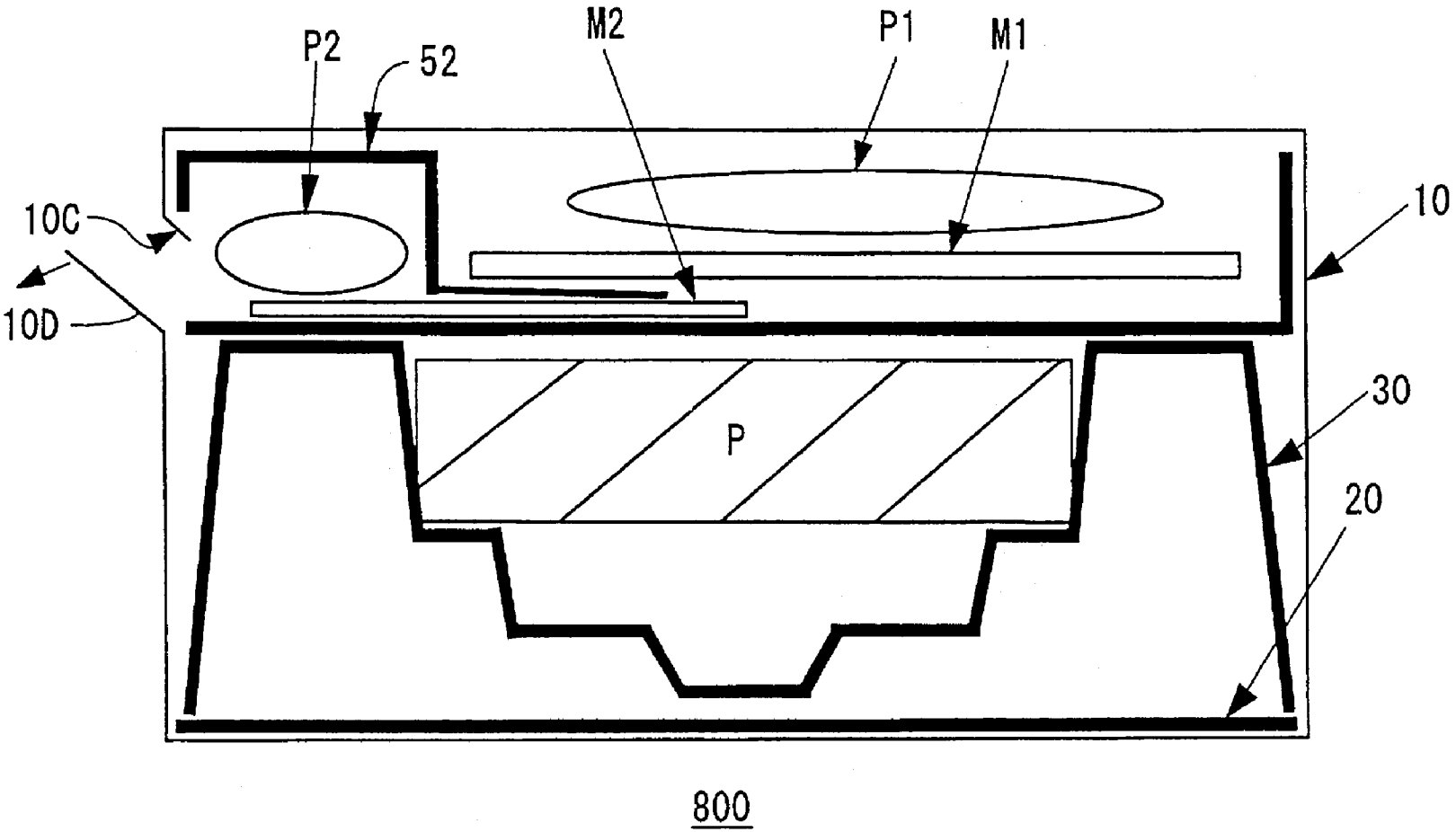
FIG. 13 is a cross-sectional view of the related art packing article.
Figure 14:
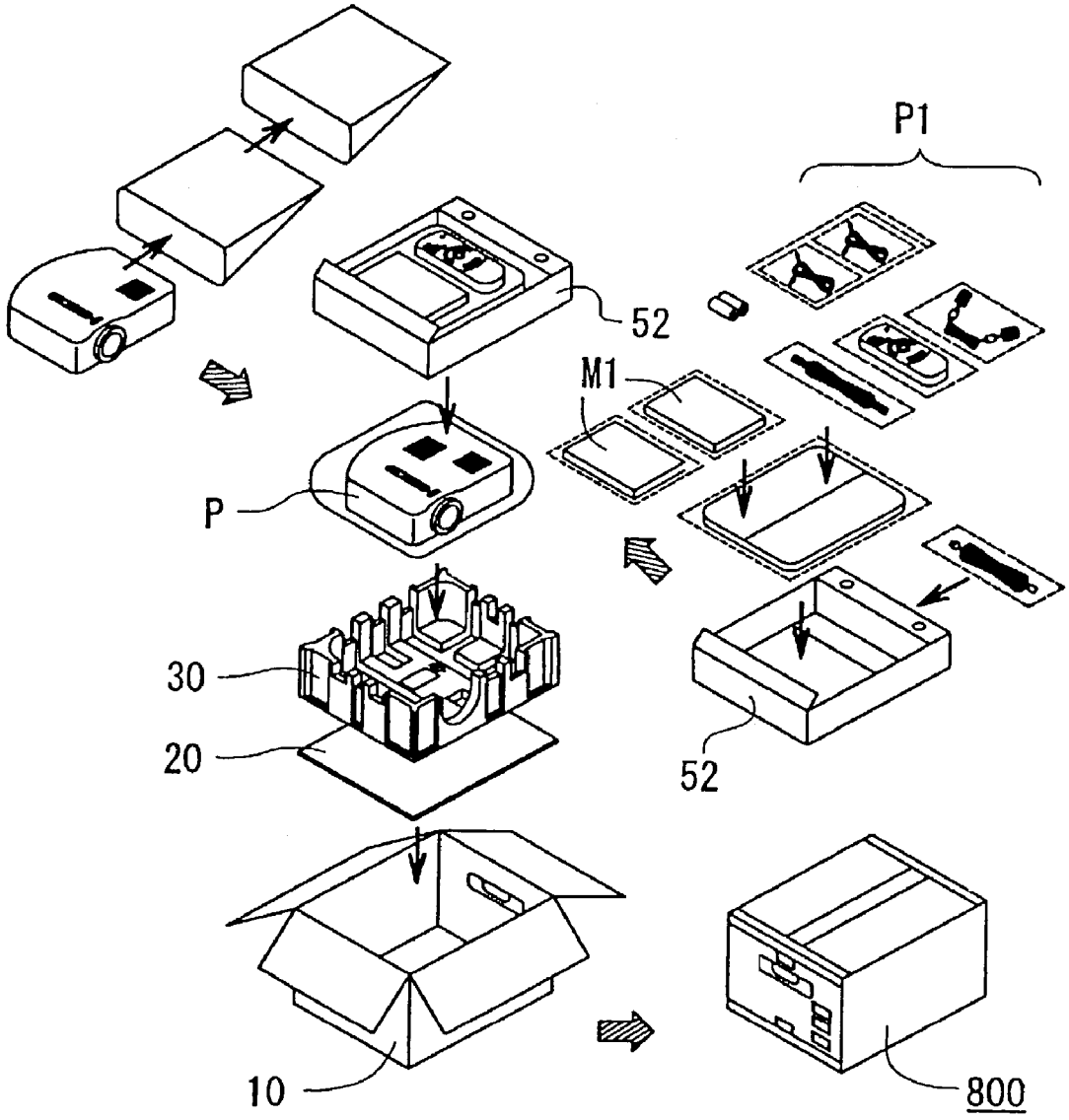
FIG. 14 is a schematic that shows assembling of the related art packing article.
Figure 15:
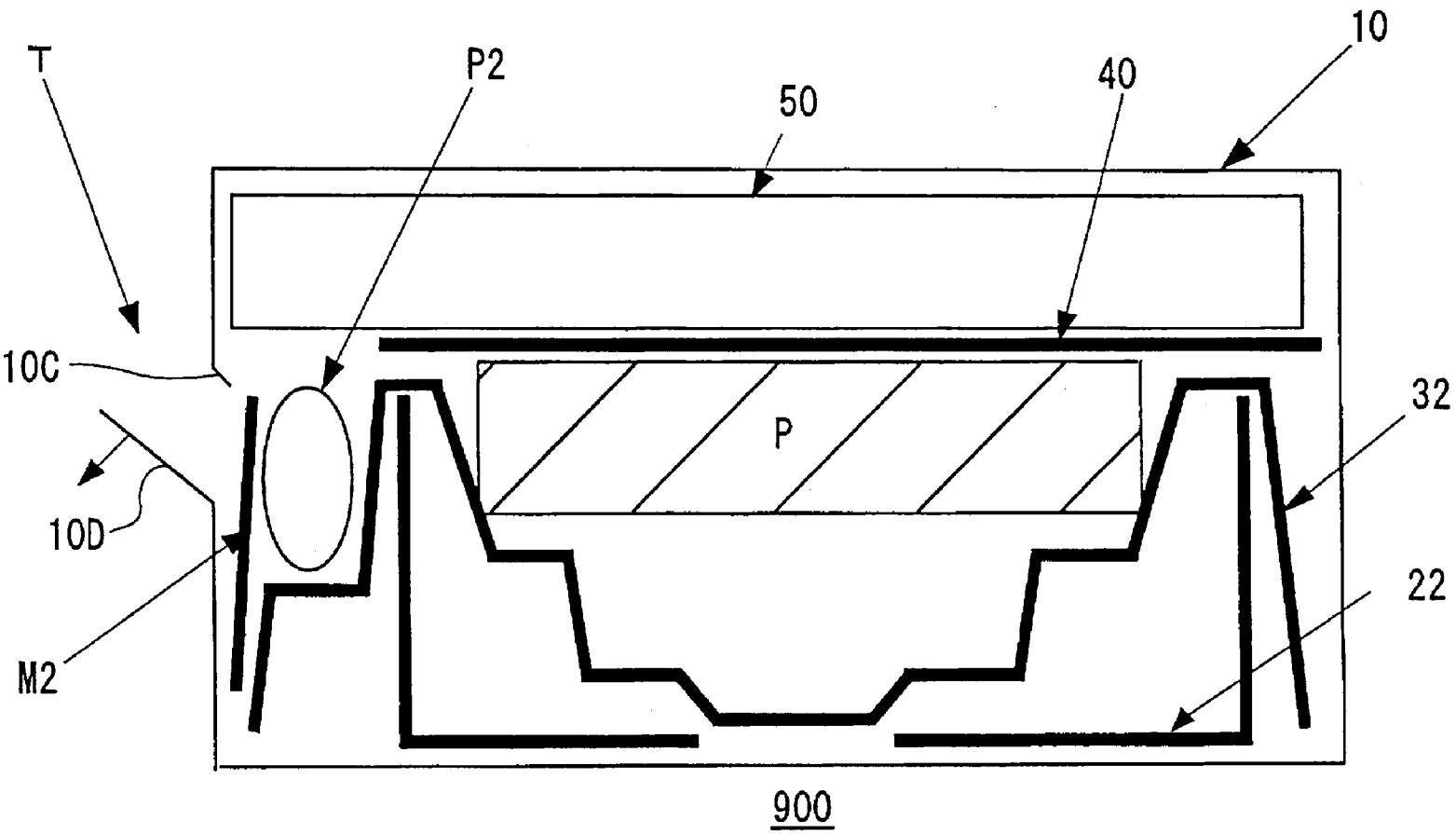
FIG. 15 is a cross-sectional view of the related art packing article.
Figure 16:
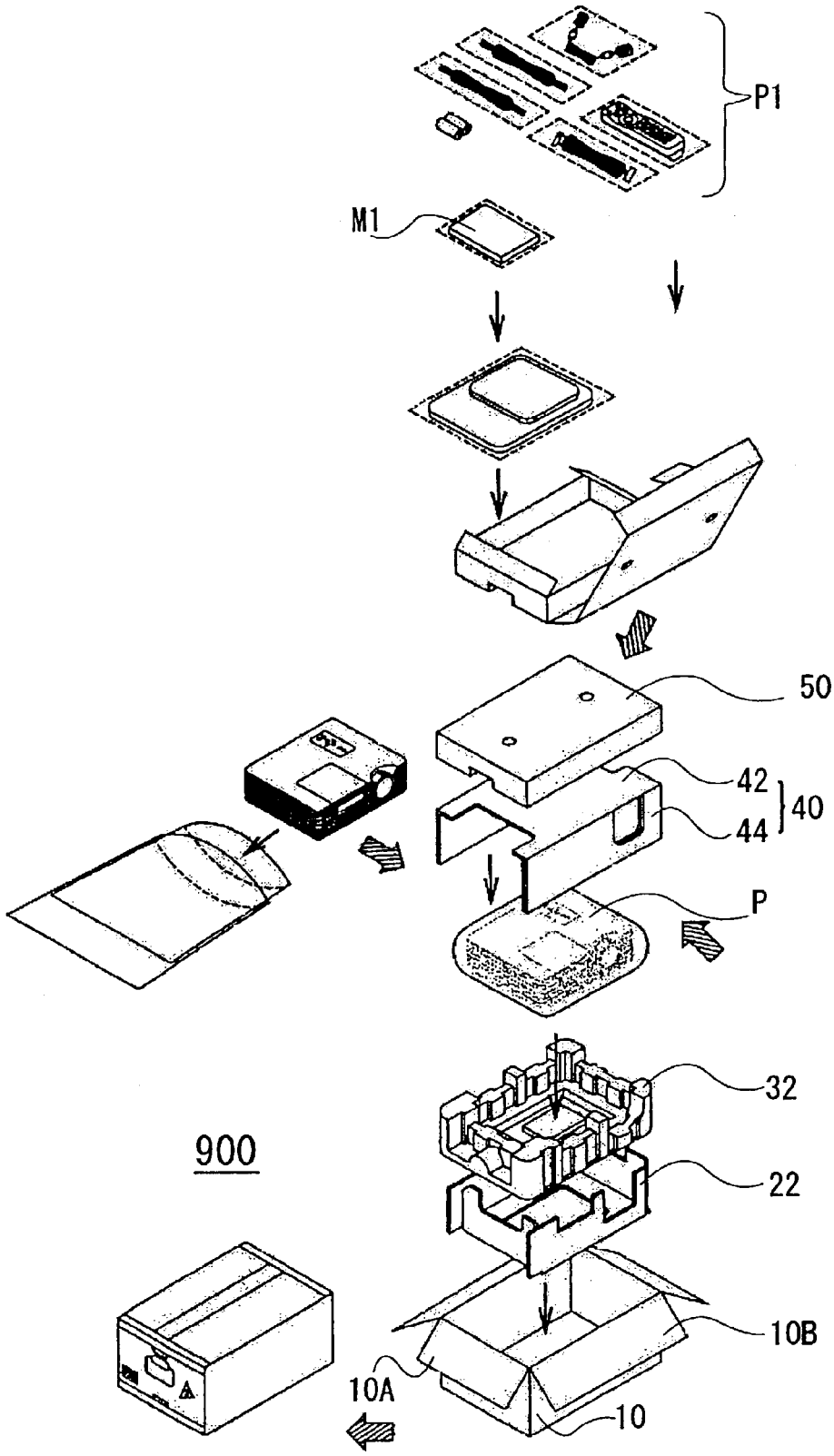
FIG. 16 is a schematic that shows assembling of the related art packing article.

FIG. 10 is a cross-sectional view of exemplary embodiment 4 of the present invention. The difference between the packing article 300 of exemplary embodiment 4 and the packing article 100 of exemplary embodiment 1 is the lower buffering portion to provide packing. Namely, the lower buffering portion to provide packing 30 of the packing article 100 of exemplary embodiment 1 is made of pulp mold and located directly on the lower pad 20. On the other hand, the lower buffering portion to provide packing 32 of the packing article 100 of exemplary embodiment 4 is made of thin bubble foam, such as polyethylene terephthalete, and located with the reinforcing spacer 22. This structure is the same as the related art packing article 900 shown in FIG. 15 and FIG. 16. The packing article 400 of exemplary embodiment 4 is basically the same as the packing article 100 of exemplary embodiment 1 except for the above-mentioned structure. The packing article 400 of exemplary embodiment 4 includes the partition member 110 as well as the packing article 100 of exemplary embodiment 1.

In accordance with this structure of the packing article 400 of exemplary embodiment 4, the number of buffering members to provide packing, which are made of relatively expensive bubble resin, can be reduced by half. Thus, a packing cost is reduced and a transportation fee is also reduced thereby since the volume of a packing article is small. Further, a buffering function is enhanced by interaction between the outside partition member 120 and the inside partition member 130 as well as exemplary embodiment 1.

What is claimed is:

1. A packing article for use with at least one of an attached part and an instruction manual, comprising:

a packing box defining a bottom and a top surface;

an item to be packed defining an upper side;

a lower-side buffering member to provide packing, the lower-side buffering member defining a center and including a concave portion, which is located adjacent the bottom of the packing box, and which locates the item to be packed at the center, the item to be packed being located in the concave portion of the lower-side buffering member;

a partition member disposed at the upper side of the item to be packed, the partition member including an outside partition member, including an upper surface member and an outside skirt portion connected to the upper surface member, and an inside partition member, including a lower surface member and an inside skirt portion connected to the lower surface member; and a storing member disposed between the partition member and the top surface of the packing box, and storing the at least one of the attached part and the instruction manual.

2. The packing article claimed in claim 1, the partition member being made of corrugated cardboard.

3. The packing article claimed in claim 2, the partition member including a protrusion which is formed by: cutting a part of a ridgeline of a bent portion of said inside partition member, and bumping the upper surface member of said outside partition member so that buffering function is enhanced.

4. The packing article claimed in claim 2, the partition member including a protrusion which is formed by: cutting a part of a ridgeline of a bent portion of said inside partition member, and bumping the outside skirt portion of said outside partition member so that buffering function is enhanced.

5. The packing article claimed in claim 2, the partition member including a protrusion which is formed by: cutting a part of a ridgeline of a bent portion of said outside partition member, and bumping a side of said packing box so that buffering function is enhanced.

6. The packing article claimed in claim 3, a mesh direction of said corrugated cardboard at said protrusion being parallel with a protruded direction of said protrusion.

7. The packing article claimed in claim 1, said outside partition member being intergraded with said inside partition member.

8. The packing article claimed in claim 1, said outside partition member being separated from said inside partition member.

9. The packing article claimed in claim 1, the packing article including a throwing opening to enable passage therethrough of at least one of an additional part and an additional document after the packing article is closed, and an opening in said partition member to store the at least one of the additional part and the additional document.

10. The packing article claimed in claim 1, the upper surface member of the outside partition member of said partition member including an opening in a center thereof.

11. The packing article claimed in claim 1, the storing member being made of corrugated cardboard.

12. The packing article claimed in claim 1, the lower-side buffering member being made of at least one of pulp mold material or bubble resin material.

* * * * *